US005275355A

United States Patent [19]

Grosswendt et al.

[11] Patent Number: 5,275,355

[45] Date of Patent: Jan. 4, 1994

[54] ANTITANK WEAPON FOR COMBATING A TANK FROM THE TOP

[75] Inventors: Werner Grosswendt, Ratingen-Lintorf; Gerhard Glotz; Helmut Peller, both of Dusseldorf, Fed. Rep. of Germany

[73] Assignee: Rheinmetall GmbH, Ratingen, Fed. Rep. of Germany

[21] Appl. No.: 18,567

[22] Filed: Feb. 4, 1987

[30] Foreign Application Priority Data

Feb. 5, 1986 [DE] Fed. Rep. of Germany ..... 3603497

[51] Int. Cl.[5] ..... F42B 10/66; F42B 12/16

[52] U.S. Cl. ..... 244/3.22; 102/374; 102/476

[58] Field of Search ..... 244/3.22, 3.1; 102/476, 102/213, 214, 374, 379

[56] References Cited

U.S. PATENT DOCUMENTS

| | | | |
|---|---|---|---|
| 2,804,823 | 9/1957 | Jablansky | 102/476 |
| 3,282,540 | 11/1966 | Lipinski | 102/213 |
| 3,485,461 | 12/1969 | Katsanis | 244/3.22 |
| 4,262,596 | 4/1981 | Allier et al. | 102/476 |
| 4,657,208 | 4/1987 | Miller, Jr. et al. | 244/3.22 |

FOREIGN PATENT DOCUMENTS

| | | | |
|---|---|---|---|
| 1578139 | 12/1971 | Fed. Rep. of Germany . | |
| 2612327 | 10/1976 | Fed. Rep. of Germany . | |
| 2830859 | 3/1979 | Fed. Rep. of Germany . | |
| 2757664 | 6/1979 | Fed. Rep. of Germany . | |
| 3120447 | 5/1983 | Fed. Rep. of Germany . | |
| 3427227 | 1/1986 | Fed. Rep. of Germany . | |
| 2425049 | 11/1979 | France . | |
| 574094 | 3/1976 | Switzerland . | |
| 2002885 | 2/1979 | United Kingdom . | |
| 2149066 | 6/1985 | United Kingdom | 102/476 |

*Primary Examiner*—Charles T. Jordan

*Attorney, Agent, or Firm*—Spencer, Frank & Schneider

[57] ABSTRACT

A projectile for a surface-to-surface weapon to combat a target from the top. The projectile includes a warhead; a propulsion system for accelerating the projectile directly after the projectile is placed in flight; a stabilizing guide assembly; a sensor for detecting a target in a longitudinal and lateral direction; and a pulse generator for turning the projectile about its center of gravity. The projectile additionally includes electronics for activating the warhead and for controlling the propulsion system and the pulse generator. A control unit rotates independently of the shaped charge warhead and houses the sensor, pulse generator and electronics. The pulse generator is arranged offset with respect to the sensor in the circumferential direction of the control unit. The electronics actuates the pulse generator in response to the sensor detecting a target, at a given distance ahead of such target, to produce a measured and radially directed control pulse to pivot the projectile so that it is aimed directly at the top of the target. The propulsion system additionally includes a drive assembly which is fired to accelerate the projectile toward a target, immediately after the projectile has been pivoted toward the target by the pulse generator. A mechanism is provided for preventing a restoring force generated by the ambient air from returning the projectile to the direction of flight existing prior to being pivoted.

20 Claims, 2 Drawing Sheets

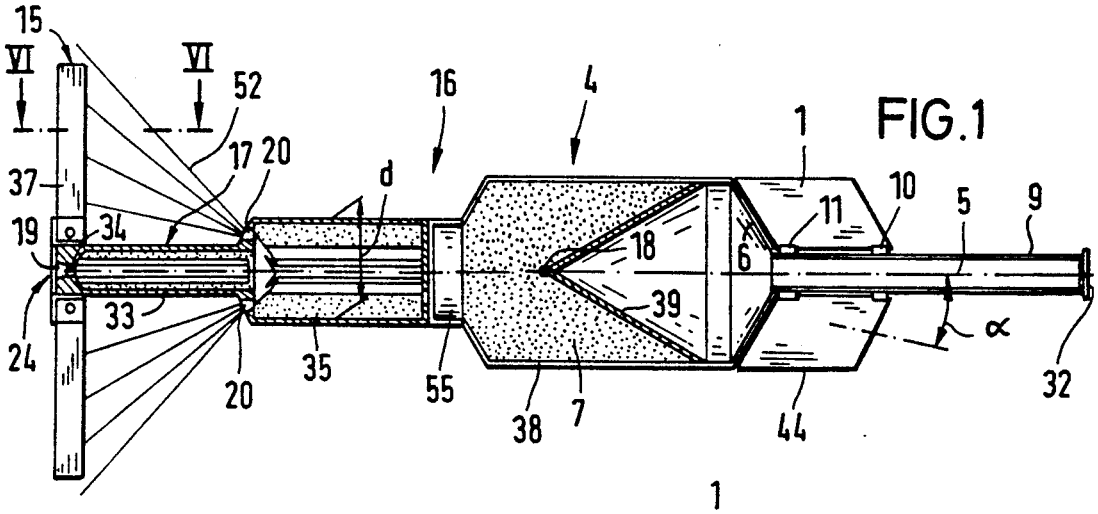
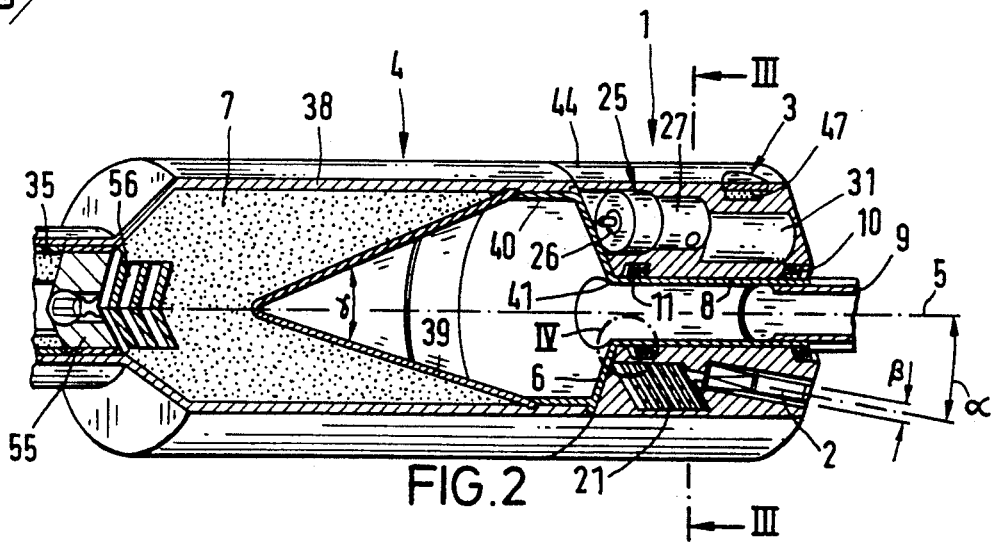
FIG.2
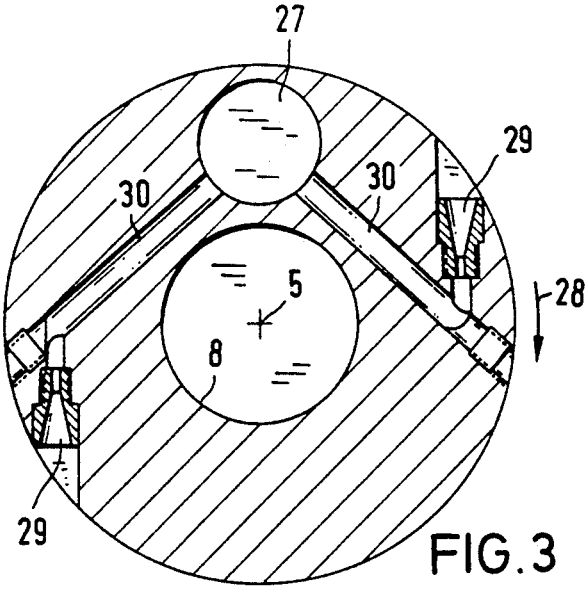
FIG.3
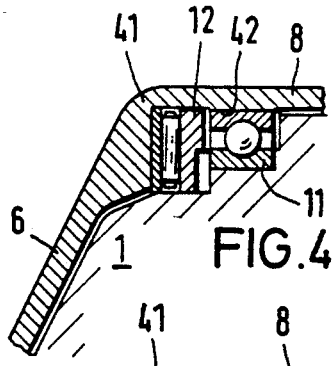
FIG.4
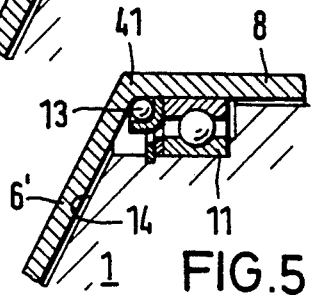
FIG.5

ANTITANK WEAPON FOR COMBATING A TANK FROM THE TOP

BACKGROUND OF THE INVENTION

The present invention relates to a weapon such as an antitank weapon to combat a tank from the top. In such a weapon, the projectile includes a shaped charge warhead, a propulsion means located in the tail section of the projectile for accelerating the projectile directly after the projectile is placed in flight, a stabilization guide means, a sensor means for detecting the target, and a solid state guide pulse generator for turning the projectile about its center of gravity.

Such an antitank weapon is disclosed in German Offenlegungsschrift [laid-open patent application] No. 2,830,859 and serves the purpose of combating a tank from the top so as to hit its roof sections, since frontal and lateral armor protection has been augmented considerably. For this purpose, the antitank projectile is in the form of a rocket and pivots, during its flight over the target, into a position where it is oriented from the top to the bottom so as to detonate its shaped charge in a vertical position at a distance above the tank.

The drawback of this defensive weapon is that the effectiveness of the shaped charge at the target depends on the attainable combat distance and is drastically reduced by a continuous horizontal movement during fly-over. In such a fly-over, the shaped charge will have only something similar to a spreading effect on the target, which may reduce its power up to 50%.

Another significant drawback of the prior art antitank weapon is that the course is detected by a magnetic type sensor which is operable only at comparatively short distances. Due to the fact that the magnetic field of the earth is deformed only within close range of the tank, the response accuracy of the sensor decreases by more than 50% at a range up to 4 m and it may lie even below 20% at distances greater than 5 m. Thus, tanks moving laterally away from the target direction during the flight of the projectile may possibly no longer be covered by the sensor. Moreover, if the projectile flies past the side of the tank, it remains ineffective in any case since its explosive charge is in a vertical detonation position.

Additionally, the known antitank projectile requires a complicated control device to guide it. For example, a plurality of pulse generators are necessary to turn the projectile into the vertical position.

SUMMARY OF THE INVENTION

It is an object of the present invention to make available a simple surface-to-surface antitank weapon which assures high hit accuracy and penetrating power when attacking the tank from the top or at an angle from the top from a position to the side of the tank.

The above and other objects are accomplished in the context of a weapon as first described above, wherein according to the invention the projectile additionally comprises:

electronic means for activating the shaped charge warhead and for controlling the propulsion means and the solid state guide pulse generator; and a control unit which rotates independently of the shaped charge warhead and which houses the sensor means, the solid state pulse generator and the electronic means; and wherein:

the sensor means is disposed eccentrically with respect to the projectile axis at a squint angle $\alpha$ for accurately detecting a target in the longitudinal and lateral direction with respect to the direction of flight;

the solid state guide pulse generator is arranged offset with respect to the sensor means in the circumferential direction of the control unit, the electronic means actuating the solid state guide pulse generator in response to the sensor means detecting a target, at a given distance ahead of such target, so that the solid state guide pulse generator produces a measured and radially directed control pulse to pivot the projectile about its center of gravity so that the projectile is aimed directly at the top side of such target even if it attacks such target at an angle off to the side of such target; and the propulsion means includes, in the tail section of the projectile, a rocket engine which is fired, in order to further accelerate the projectile toward a target, immediately after the projectile has been pivoted in such target direction by the pulse generator; and the tail section of the projectile includes means for preventing a restoring force generated by the ambient air from returning the projectile to the direction of flight existing prior to actuation of the solid state pulse generator.

The present invention makes it possible in an advantageous manner to make a projectile available as an antitank weapon which makes precise detection of the target possible at a great horizontal distance by means of a sensor built into a control unit which rotates at its natural frequency with respect to a shaped charge warhead, and guides the tip of the projectile by further means onto the roof of the tank during the detection process, while accelerating the projectile in the direction of the target so that the shaped charge can be detonated reliably and with high penetration power upon contact with the target.

A rotating sensor configured as a passive laser light sensor or as an active radar sensor is advantageously able to scan the ground in strips at a squint angle c formed with respect to the axis of the projectile and to detect the target early at a given, comparatively large distance ahead of the target. The rate of rotation of the control unit, which is significantly larger than the rate of rotation of the shaped charge warhead, is tuned in such a way that the spacings of the scanning loops on the ground performed by the sensor are so short in dependence on the velocity of the projectile that a tank is definitely detected. By arranging a solid state pulse generator so that it is offset within the rotating control unit, it is possible, in addition to advantageously compensating the gyrating movement of the rotating control unit, to initiate a measured and radially oriented control pulse, for example by means of an explosive charge, after the target has been detected to pivot the projectile about its center of gravity to the extent that it aims at the upper side of the tank even if it is in position to the side of the tank.

After completion of the pivoting about its center of gravity and once target direction has been attained, the projectile is further accelerated into the target in a particularly advantageous manner by means of a second rocket engine which is fired at this moment.

To prevent a restoring force generated by the external air during pivoting about the center of gravity from having an influence on the flight path, the projectile includes either means for releasing the guide assembly or nozzles oriented symmetrically toward the guide assembly to form a compression wave generated by generator gases at each fin.

Advisably, the control unit is rotatably mounted at the front of the shaped charge warhead for rotation about the guide of a detonation spacer, with the control unit being axially disposed in such a way that its axial mass inertia forces developed during the start of flight can be transferred without deformation to the shaped charge warhead. Mounting the control unit around the detonation spacer permits the configuration of an outer jacket of the control unit which has the same diameter as the shaped charge warhead. The interior of the annular control unit then permits a reasonable arrangement of a drive assembly to cause the control unit to rotate, an electronic system to actuate the solid state pulse generator and a battery, for example, to generate a current for the electronic system. By means of a drive assembly in the form of a rocket drive whose gases escape from two space saving tangentially arranged nozzles oriented in the same circumferential direction, desired rotation rates in a range from 40 to 50 revolutions per second can be realized.

Between its guide assembly and the shaped charge warhead, the antitank projectile has two rocket engines arranged one behind the other, one of which is selected to serve as added acceleration after the start of flight, and the other of which serves to accelerate the projectile after it has pivoted into the direction of the target. In the embodiment in which, after the projectile has been pivoted about its center of gravity, the guide assembly is to be released from the projectile so that recoil forces generated by the ambient air are avoided, the discharge channel for the second accelerating rocket engine in the tail section is simply closed by a plug. The gas pressure generated upon firing of this rocket engine blows the plug out, separating the guide assembly from the projectile.

The projectile is preferably suitable for firing out of a bazooka. For example, if the gunner fires from a kneeling position, a very high hitting accuracy and penetration power can be realized in a particularly advantageous manner at combat distances around 300 m.

BRIEF DESCRIPTION OF THE DRAWINGS

The invention will be described in greater detail below with reference to an embodiment which is illustrated in the drawings.

FIG. 1 is a longitudinal sectional view of an antitank projectile according to the invention.

FIG. 2 is a partially enlarged detail view of FIG. 1 showing the control unit disposed at the front end of the antitank projectile.

FIG. 3 is a sectional view along line III—III of FIG. 2 showing a rotary drive for the control unit.

FIG. 4 is an enlarged sectional view of an axial bearing of the control unit shown as detail IV in FIG. 2.

FIG. 5 shows a variation of the axial bearing of the control unit shown as detail IV in FIG. 2.

DESCRIPTION OF THE PREFERRED EMBODIMENT

Figure 6:
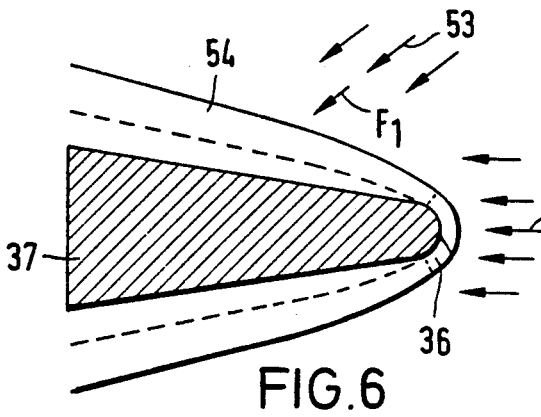
FIG. 6 is a sectional view along line VI—VI in FIG. 1 showing a cross section of a guide assembly fin with existing compression wave.

FIGS. 1 and 2 show a projectile 16 composed of a shaped charge warhead 4 equipped with a conventional impact detonator 32, a control unit 1 which acts during flight to effect course corrections for direct homing in on the upper side of a target, preferably the upper side of a tank 23 or a tank turret 43 (FIG. 8), drive assemblies 33, 35 arranged in the tail of the projectile for generating thrust, and a stabilization guide assembly 15.

Within its essentially tubular warhead body 38, the shaped charge warhead 4 includes a conical metal insert 39 whose cone angle $\gamma$ lies in a range around 60°, to produce. for example, a high penetrating power. The warhead further includes a fastener 40 at its front end for a frontal covering hood 6 for the shaped charge. Covering hood 6 is composed of a forwardly converging cone frustum whose front edge 41 forms an open cross section and is connected with a guide 8 of a detonation spacer 9 which can be pushed into shaped charge warhead 4 in a telescoping manner. At its front end, spacer 9 accommodates an impact fuze 32 which is spaced from the shaped charge at an optimum firing distance. While the inner region of guide 8 is configured as a slide bushing for detonating spacer 9, the exterior of guide 8 is provided with frontal and rear bearing locations for accommodating a front and rear radial bearing 10, 11 for permitting rotation of control unit 1 separately from the shaped charge warhead.

To nondestructively transfer the axial mass inertia forces of control unit 1 generated at the start of flight of projectile 16, an axial bearing 12 (FIG. 4) supported on covering hood 6 is associated with rear radial bearing 11. According to a variation shown in FIG. 5, which differs from the one shown in FIG. 4, an elastic element, for example an elastic O-ring 13, may also be disposed between rear radial bearing 11 and covering hood 6. The axial mass inertia forces generated during start-up compress this elastic element in such a manner that these forces can be transferred over a large area from the rear frontal face 14 of control unit 1 to cover 6'.

Control unit 1 is arranged in a ring, with its outer jacket 44 coinciding with the outer diameter of body 38 of the warhead charge. A rigid sensor 2 is provided in the interior of control unit 1 to accurately detect a target having, for example a longitudinal dimension 45 and a lateral dimension 46 of a tank in combat position (FIG. 8), at a distance L between 15 m and 30 m ahead of the target. This sensor is preferably configured as either a passive laser light sensor or an active radar sensor, both of which are known per se. With particular reference to FIGS. 2 and 9, sensor 2 is disposed at a squint angle $\alpha$ eccentrically to projectile axis 5 within control unit 1. With a squint angle $\alpha$ in a range between 11° and 15° and a viewing angle $\beta$ which may be, for example, 3°, sensor 2 is able, while rotating very fast in a range between preferably 40 to 50 revolutions per second, to scan the ground in strips (FIG. 8) and to thus reliably detect the target.

If a radar sensor is used, the high reflection capability of the metal tank (FIG. 8) is utilized for accurate detection of the target at a distance L between 15 and 30 m ahead of the target. A laser light sensor will detect the target just as reliably and accurately from such a distance if the gunner illuminates the target in a manner not shown during the flight of the projectile.

To generate high inherent rotation, a drive assembly 25 is provided within control unit 1 eccentric to the axis of projectile 5. This drive assembly is composed of a rocket drive 27 actuated by a detonator element 26 both of which are generally known. According to FIG. 3, two tangentially arranged drive nozzles 29, arranged symmetrically on the circumference of control unit 1 and oriented in a direction opposite to direction of rotation 28 are connected, each by way of a gas guide channel 30, with the rocket drive 27 which is preferably in the form of a gas generator.

Within control unit 1, a battery 31, activated by drive assembly 25, is associated with the latter to generate current for an electronic system 21 and for impact fuze 32 disposed at the front tip of spacer 9.

Figure 7:
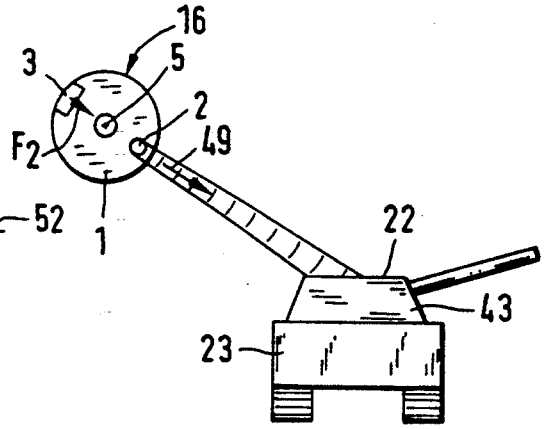
FIG. 7 is a front view of the antitank projectile in a position above the tank and offset to the side of the tank.

To effect course corrections, control unit 1 further includes a solid state pulse generator 3 which, once sensor 2 has detected the target, emits a measured and radially oriented control pulse to change the position of projectile axis 5 by pivoting it around the center of gravity 18 of the projectile so that the upper side 22 of tank 23 or of turret 43, respectively, can be sighted directly even if the tank 23 is being attacked from the side (FIG. 7). Solid state pulse generator 3 is here offset with respect to sensor 2 in the circumferential direction of control unit 1, and preferably it is disposed opposite the outer jacket region and is composed, for example, of an explosive charge 47 so as to generate a short-term control pulse at the instant the target is sensed for pivoting the projectile so that it points directly toward the top of the target.

Due to the fact that a gunner 50 can fire this antitank projectile 16 at the target (see FIG. 8) preferably from a recoilless, d- caliber bazooka (not within the scope of the invention), with the gunner aiming at the tank in a manner not shown, but firing the weapon in fact at a holding point 48 (FIG. 9) of a target window (not shown) at a height h of, for example, 4 m above the ground, the flight path 51 is approximately horizontal for all combat distances up to 300 m at a target distance L preferably 20 m before the target. For that reason, if there is only a slight deviation from flight path 51 with respect to the horizontal, the necessary control pulse to turn the projectile into the direction of the target can be generated in a simple manner by always using the same quantity and power of an explosive charge 47. Assuming the above-mentioned exemplary flight path data, the sensor 2 detects the target at a constant target distance L of preferably 20 m and explosive charge 47 is simultaneously actuated by electronic system 21, which is operatively connected with sensor 2 and disposed in control unit 1.

In a particularly advantageous manner, such a control mechanism for projectile 16 is also suitable for striking a target which is laterally offset with respect to the target sighted by the gunner, because the force $F_2$ (FIG. 7) generated by the control pulse to produce the change in course is always directed radially to the axis 5 of the projectile and the direction of force $F_2$ can thus easily be brought into coincidence with the direction of inclination of the new flight direction 49 (FIG. 7) directed toward the upper side 22 of tank 23 or turret 43, respectively (FIG. 8) due to the positioning determining target detection by sensor 2 and due to the position oriented actuation by electronic system 21.

In order to maintain a direct course toward the target, pivoting of projectile 16 about its center of gravity 18 goes along with further acceleration of projectile 16 toward the target in that a rocket engine 33 or 35 disposed in the tail of the projectile and configured as a second drive assembly is fired at the same time.

However, during pivoting of projectile 16 about its center of gravity 18 care must be taken that restoring forces resulting from the change in flow of the ambient air on the obliquely oriented fins 37 (FIG. 6) of guide assembly 15 cannot become effective to return projectile 16 into its original flight direction 51 (FIG. 9). For this purpose, the tail section 17 of projectile 16 is provided according to one embodiment of the invention with means 24 for releasing guide assembly 15 from the projectile and, according to another embodiment of the invention, with nozzles 20 oriented symmetrically toward the guide assembly for forming a compression wave 36 (FIG. 6) from the generator gases.

To additionally accelerate projectile 16 when it is turned in the direction toward the target and to avoid the generation of restoring forces by the ambient air and to increase the acceleration at the start, two drive assemblies in the form of rocket engines 33, 35 are disposed one behind the other between guide assembly 15 and shaped charge 7 to become effective in succession during flight toward the target. For example, if the front rocket engine 35 is used to provide additional acceleration of projectile 16 immediately after the start of flight, rear rocket engine 33 is used to additionally accelerate the projectile toward the target when pivoted into the target direction. On the other hand, according to a reverse firing sequence controlled by electronic system 21, rear rocket engine 33 can serve to provide additional acceleration at the start while front rocket engine 35 accelerates projectile 16 after pivoting in the target direction. Using the additional acceleration at the start causes, for example, a projectile having a weight of approximately 6 kg to be accelerated from an initial speed of 100 m/s in 0.2 s generated by a starting charge (not shown) to a speed of 150 to 170 m/s in 0.2 to 0.5 second.

In the embodiment in which rear rocket engine 33 is used to further accelerate projectile 16 after it has been turned in the target direction, an axially disposed discharge nozzle 34 is closed by a plug 19, which serves as a means 24 for releasing guide assembly 15 when rocket engine 33 is fired. Plug 19 is here fixed to guide assembly 15 in a suitable manner. Plug 19 is then ejected from projectile 16 together with guide assembly 15 by the pressure of the gases generated by rocket engine 33.

Front rocket engine 35, whose outer diameter d is larger than that of rear rocket engine 33, corresponds to the caliber of the firing tube of the weapon (not shown).

In the embodiment in which rear rocket engine 33 is used to provide additional acceleration at the start of flight, discharge nozzle 34 may be left opened. In this embodiment discharge nozzles 20 of front rocket engine 35 are arranged in symmetrical distribution on a circle at the rear end of this engine and are conically outwardly oriented toward fins 37 so that a compression wave 36 as shown in FIG. 6 can form at each fin 37 of guide assembly 15, for use, for example, as additional acceleration in the target direction. Fins 37 are then subjected to a supersonic gas jet 52 from rocket engine 35, for example at 4.5 times the speed of sound, so that a compression wave can form around fins 37 due to the substantially slower velocity of the stream of ambient air which, by being discharged in the lateral fin regions 54 prevents a course changing influence of the stream of air 53 on fins 37 until the target is reached.

Figure 8:
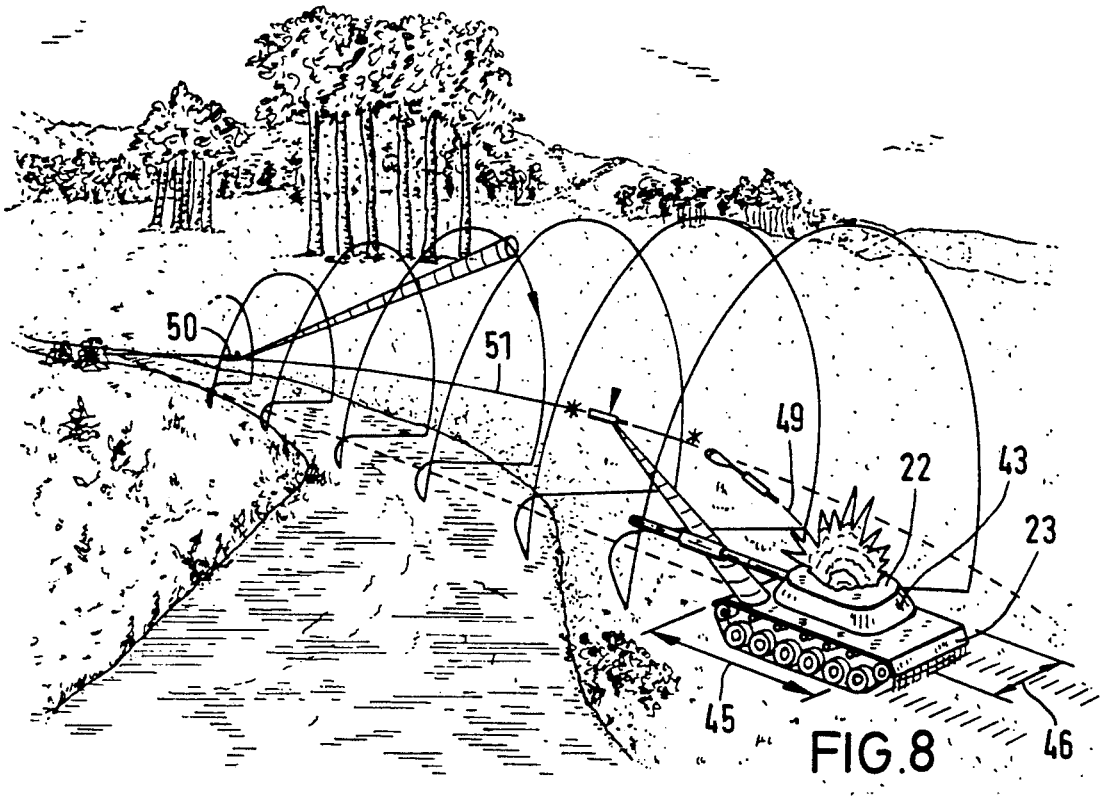
FIG. 8 is a perspective view of the flight path of an antitank projectile from the combat position of a gunner to its impact on the roof of a tank.
Figure 9:
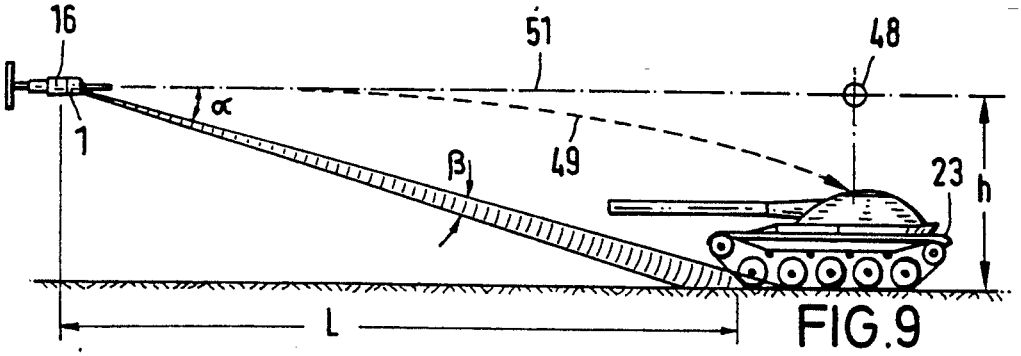
FIG. 9 is a schematic representation of the flight path of the antitank projectile after the target has been detected in the sighting direction.

Such a projectile 16 makes it possible to hit the upper side 22 of tank 23, or turret 43, reliably and with a high penetrating power at a firing distance, as shown in FIG. 8, from gunner 50 to tank 23 of, for example, 300 m. As will be appreciate by those skilled in the art, when fuze 32 hits the target, shaped charge 7 will be detonated at the optimum distance given by spacer 9 which forms an effective spike, with the detonation being effected in a known manner by firing and safety device 55 disposed at the tail end of shaped charge 7 and under the guidance of a detonation wave guide 56.

A projectile 16 of such configuration can also be used to advantage for medium ranges up to 2000 m, in which case it is necessary, however, to bring the projectile to the target by means of weapons, for example, guns, which have a longer range.

It will be understood that the above description of the present invention is susceptible to various modifications, changes and adaptations, and the same are intended to be comprehended within the meaning and range of equivalents of the appended claims.

What is claimed is:

1. In a projectile for a surface-to-surface weapon to combat a target from the top, the projectile including: a shaped charge warhead; a propulsion means located in a tail section of the projectile and including a first drive assembly for accelerating the projectile directly after the projectile is placed in flight; a stabilizing guide means; sensor means for detecting a target; and a solid state guide pulse generator for turning the projectile about its center of gravity; the improvement comprising:

electronic means for activating the shaped charge warhead and for controlling said propulsion means and said solid state guide pulse generator; and a control unit which rotates independently of the shaped charge warhead; said control unit housing said sensor means, said solid state guide pulse generator and said electronic means; and wherein:

said sensor means is disposed eccentrically with respect to the projectile axis at a squint angle $\alpha$ for accurately detecting a target in a longitudinal and a lateral direction with respect to the direction of flight;

said solid state guide pulse generator is arranged offset with respect to said sensor means in the circumferential direction of said control unit; said electronic means actuating said solid state guide pulse generator in response to said sensor means detecting a target, at a given distance ahead of such target, so that said solid state guide pulse generator produces a measured and radially directed control pulse to pivot said projectile about its center of gravity so that said projectile is aimed directly at the top side of such target even if it attacks such target at an angle off to the side of such target;

said propulsion means includes, in the tail section of said projectile, a second drive assembly in the form of a rocket engine, the rocket engine of said second drive assembly being fired, in order to further accelerate said projectile toward a target, immediately after said projectile has been pivoted in such target direction by said pulse generator; and the tail section of said projectile includes means for preventing a restoring force generated by the ambient air from returning said projectile to the direction of flight existing prior to actuation of said solid state guide pulse generator.

2. Projectile as defined in claim 1, including: a front covering hood covering the shaped charge; a detonation spacer; a detonation spacer guide connected with said covering hood and having an interior surface serving as a slide bushing for slidably accommodating said detonation spacer and an exterior surface; and radial bearing means mounted on the exterior surface of said detonation spacer guide for rotatably supporting said control unit.

3. Projectile as defined in claim 2 wherein said radial bearing means includes a rear radial bearing located adjacent said covering hood, and further including an axial bearing supported on said covering hood, wherein the axial mass inertia forces generated by said control unit during the start of flight are transferred from said rear radial bearing to said covering hood by means of said axial bearing.

4. Projectile as defined in claims 2, wherein said control unit has a rear frontal face adjacent said covering hood, and wherein said radial bearing means includes a rear radial bearing located adjacent said covering hood, and further including an elastic element disposed between said rear radial bearing and said covering hood wherein said elastic element is compressed by axial mass inertia forces generated during the start of flight by said control unit so that these forces are transferred directly from said rear frontal face of said control unit to said covering hood.

5. Projectile as defined in claim 1, including a third drive assembly for causing said control unit to rotate and being disposed within said control unit.

6. Projectile as defined in claims 5, wherein said third drive assembly comprises a primer and a rocket drive actuated by said primer, said rocket drive being arranged eccentric to the longitudinal axis of said projectile, said projectile further including two tangentially arranged nozzles disposed symmetrically opposite one another on the circumference of said control unit and oriented opposite to the direction of rotation, and gas channels connecting each said nozzle with said rocket drive.

7. Projectile as defined in claim 5, wherein said control unit has a desired rate of rotation generated by said third drive assembly which is a multiple of a natural rotation of said projectile.

8. Projectile as defined in claim 7, wherein said third drive assembly causes said control unit to rotate at 40 to 50 revolutions per second.

9. Projectile as defined in claim 5, including a detonation spacer having a front tip and being slidably mounted for telescoping into the shaped charge warhead; an impact fuze disposed at the front tip of said detonation spacer; and a battery disposed within said control unit and connected to said electronic means, said battery being activated by said third drive assembly to generate a current for said electronic system and for said impact fuze.

10. Projectile as defined in claim 1, wherein said means for preventing a restoring force includes nozzles oriented symmetrically toward said stabilization guide means for ejecting gases to form compression waves for preventing said restoring force.

11. Projectile as defined in claims 10, wherein said first and second drive assemblies are two rocket engines arranged one behind the other between said stabilization guide means and said shaped charge and which become selectively effective in succession.

12. Projectile as defined in claim 11, wherein the rocket engine of said first drive assembly is located, with respect to the direct of flight, behind the rocket engine of said second drive assembly.

13. Projectile as defined in claim 12, wherein said stabilization guide means includes fins, and said nozzles for ejecting gases to form compression waves during target acceleration are disposed at the rear end of the rocket engine of said second drive assembly in symmetrical distribution on a circle, with each nozzle opening being oriented conically outwardly so that a compression wave forms at each fin of said stabilization guide means.

14. Projectile as defined in claim 1, wherein said means for preventing a restoring force includes means for releasing said stabilization guide means from said projectile.

15. Projectile as defined in claims 14, wherein said first and second drive assemblies are two rocket engines arranged one behind the other between said stabilization guide means and said shaped charge and which become selectively effective in succession.

16. Projectile as defined in claim 15, wherein the rocket engine of said second drive assembly is located, with respect to the direction of flight, behind the rocket engine of said first drive assembly.

17. Projectile as defined in claim 16, further including a discharge nozzle connected to the rear of the rocket engine of said second drive assembly, and wherein said means for releasing includes a plug connected to said stabilization guide means and being inserted in said discharge nozzle for closing said discharge nozzle until the rocket engine of said second derive assembly is fired in response to which said plug is removed from said discharge nozzle, simultaneously releasing said stabilization guide means from said projectile.

18. Projectile as defined in claim 1 wherein said sensor means detects a target at a distance which lies in a range between 15 m and 30 m ahead of such target.

19. Projectile as defined in claim 1, wherein said sensor means comprises a passive laser light sensor.

20. Projectile as defined in claim 1, wherein said sensor means comprises an active radar sensor.

* * * * *